United States Patent [19]

Romagnoli

[11] Patent Number: 4,793,568

[45] Date of Patent: Dec. 27, 1988

[54] CONE FOR DYEING YARNS REELED ON SPOOLS WITH AXIAL SEAT TO GUIDE THE STEM AND RECESS FOR THE INTERPENETRATION OF SUPERIMPOSED CONES

[75] Inventor: Tiziano Romagnoli, Florence, Italy

[73] Assignee: Mariplast S.p.A., Italy

[21] Appl. No.: 116,006

[22] Filed: Oct. 30, 1987

[30] Foreign Application Priority Data

Nov. 11, 1986 [IT] Italy ..... 11915/86[U]

[51] Int. Cl.[4] ..... B65H 75/20

[52] U.S. Cl. ..... 242/118.1; 242/118.3

[58] Field of Search ..... 242/118.1, 118.11, 118.2, 242/118.3, 118.31, 118.32; 68/189, 198

[56] References Cited

U.S. PATENT DOCUMENTS 2,489,465 11/1949 Russell ..... 242/118.1 X
2,675,194 4/1954 Steverlynck ..... 242/118.1
2,746,280 5/1956 Russell ..... 242/118.1 X
4,180,219 12/1979 Becker et al. ..... 242/118.1

FOREIGN PATENT DOCUMENTS 84986 2/1958 Denmark ..... 242/118.1
1416340 9/1965 France ..... 242/118.1

*Primary Examiner*—Stanley N. Gilreath
*Attorney, Agent, or Firm*—McGlew and Tuttle

[57] ABSTRACT

A cone for dyeing reeled yarns and for equivalent uses, with a truncated-cone wall pervious and having such a thickness so as to create, along a portion of its length, an axial through seat for the centering over the stems of the dyeing equipment and with an axial recess formed by the end part of the truncated-cone wall and an annular bottom, which axial recess is apt to receive the narrowest part of an axially adjacent cone, thereby the cones fitted onto the same stem penetrate partially one into the other.

4 Claims, 1 Drawing Sheet

CONE FOR DYEING YARNS REELED ON SPOOLS WITH AXIAL SEAT TO GUIDE THE STEM AND RECESS FOR THE INTERPENETRATION OF SUPERIMPOSED CONES

At present, traditional cones are used for dyeing reeled yarns made up of a perforated truncated-cone skirt on which the yarn is wound to form a reel or spool; a number of cones having respective reels of yarn thereon are fitted on each one of a number of relatively thin stems, which the dyeing equipment is provided with, the equipment having a container to be closed when carrying out the dyeing; the stems may be tubular or perforated, so as to allow the dyeing liquid pressed through the stems to come out laterally thereof into the cone cavity and, through the cone holes, to go through the yarn mass to be dyed. In other cases, said stems have a cross-like section and the dyeing liquid is introduced from below and made to flow axially. These arrangements provide the use of shaped discs interposed between one dyeing cone and another in order to centre these cones over the stems, to space them apart and support the overhanging yarn reel or spool. This arrangement involves some axial overall dimensions for each cone and therefore a space loss in the dyeing containers. Moreover, the preparation for the dyeing is difficult to carry out, and the loading of the cones with the discs interposed therebetween is particularly difficult so that the possibility of automatically loading these traditional dyeing systems by means of said cones has been limited.

Other arrangements have been provided with special cones which provide a seat inside their major base, for the underlying cone. This allows a cone to be partially inserted into another thereby ensuring, on one hand, the mutual centering and, on the other hand, also a reduction of the overall dimensions of the cones and reels or spools, the latter resting one on the other to avoid the deformations to which the reels of yarn are subjected once they have absorbed the liquid, which deformations, in the prior and traditional arrangement, are prevented by the presence of the discs interposed between one cone and the other, which discs, besides the centering of the cones, have also the function of sustaining the reels in a spaced apart relationship. However these relatively recent arrangements of cones which do not require the interposed disc and allow a partial axial insertion one into the other of the cones mounted over the same stem, require, on the one hand, a transformation of the dyeing plant to make adequate the dimensions of the stem and of the mandrels of the spoolers to the centering requirements of this particular types of cones, and give rise, on the other hand, to a further difficulty in carrying out the automatic mounting owing to the difficulty of the angular centering that is usually required for the mounting for the cones in question.

The present invention refers to a cone for dyeing reeled yarns, which avoids the drawbacks of the above mentioned arrangements and offers the advantages which will be apparent to those skilled in the art from the reading of the following text. In particular, the cone according to the invention allows, on the one hand, the use of traditional equipment without modifications of the stems, also avoiding the modification of the mandrels of the existing reeling machines for the reel or spool formation; on the other hand, said cone allows the mounting without loss of axial dimensions between adjacent reels and thus with a greater number of reels with the same axial dimensions with respect to the traditional systems; moreover, all drawbacks both of the mounting of the centering and supporting discs, and the mounting with angular centering of the recent types of cones suggested by the art, are avoided.

Substantially, a cone for dyeing reeled yarns and for equivalent uses according to the invention comprises: a truncated-cone wall pervious and provided with such a thickness as to generate, along part of its length, an axial through seat for the centering of stems which, in the dyeing equipment, receive said cones; and, towards the major base, an annular bottom and a portion of side wall defining an axial recess able to receive the narrowest part of an axially adjacent cone, thereby the cones fitted on the same stem partially penetrate one into the other.

Practically, the truncated-cone wall exhibits a set of longitudinal slots having a width gradually increasing towards the outside.

The bottom of the axial recess formed in correspondence to the major base, may have an annular projection with the inner profile inclined for making up an invitation, that is a flare, for the centering in respect of the minor base of an underlying cone. Around such annular projection, through holes may be formed leading into the longitudinal slots.

In the part adjacent to the major base, in correspondence to the recess, the side wall of the recess may exhibit some slots.

The drawing shows a feasible embodiment of the invention, and in particular:

Figure 1:
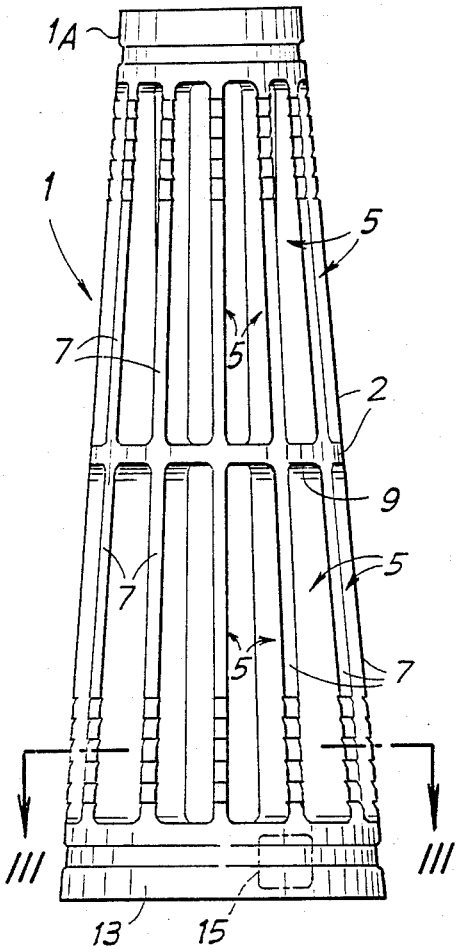
FIGS. 1 and 2 show an outer view and a longitudinal section of a dyeing cone according to the invention.
Figure 4:
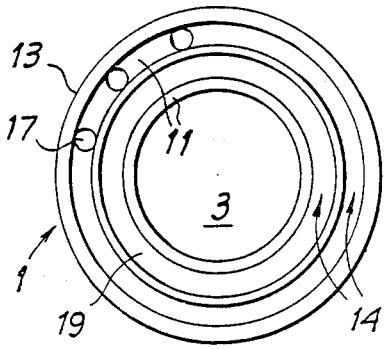
FIG. 4 shows a view taken from line IV—IV of FIG. 2.
Figure 2:
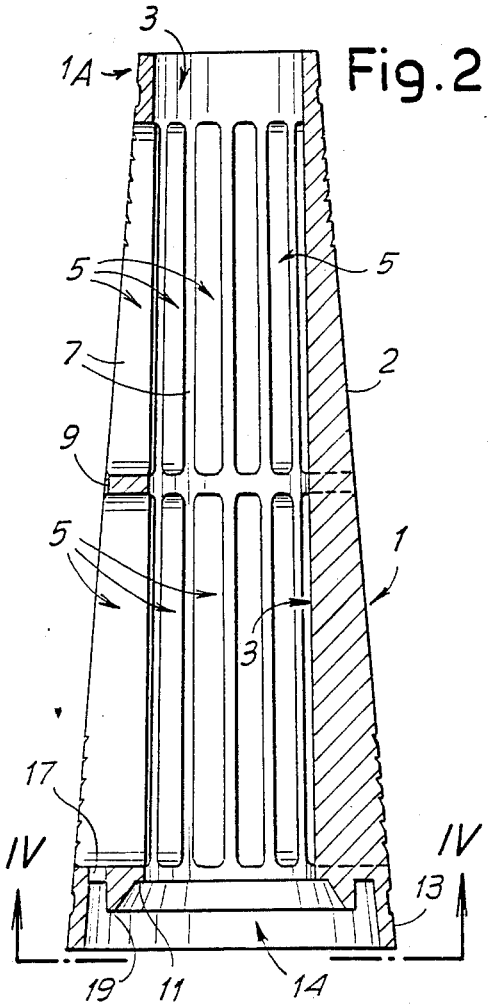
Figure 3:
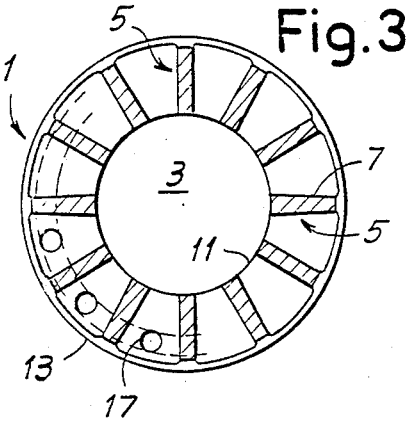
FIG. 3 shows a cross section taken on line III—III of FIG. 1.

According to what is illustrated in the accompanying drawing, numeral 1 generally indicates a dyeing cone made up of truncated-cone wall 2 having variable thickness, which defines, internally of said cone 1, an axial through-socket 3, for centering on the stem of the dyeing equipment. Said truncated-cone wall 2 has longitudinal slots 5 of radially increasing width, which give the whole truncated-cone wall the look of a set of ribbings 7 developing in the direction of the generating lines of the truncated-cone surface of cone 1. Said ribbings 7, which are reinforced by a ring 9 disposed at an intermediate zone of same ribbings, terminate in the lower zone of cone 1, that is, in the vicinity of the major base thereof, with a ring 11 below which and as far as the major base of cone 1, the truncated surface continues with a wall portion forming a skirt 13 of relatively less thickness than that of wall 2 forming ribbings 7; this wall 13 surrounds a recess 14 whose bottom is defined by ring 11.

In the wall 13 slots 15 may be provided, only one of which is indicated with chain line in FIG. 1.

The ring 11 may have holes 17 intercalated with ribbings 7 in order to ease the passage of the dyeing liquid when this is introduced from the lower part of the stem over which the cones are fitted. The drawing shows only some holes 17 which - if present - are uniformly distributed.

From ring 11 an annular projection 19 protrudes inside the recess 14, which projection surrounds the through-socket 3 and has internally a guiding or entry profile (that is, a flare) of funnel or truncated cone shape as shown in the drawing.

In use, several dyeing cones 1, on which the yarn to be dyed has been wound, are fitted onto a stem of the dyeing equipment and axially pressed, so that the end portion 1A of lesser section of each cone comes to fit, internally of the recess 14 of the overhanging cone, into the recess 14 against the ring 11, a centering of the end portion 1A being easily carried out by the projection 19; this facilitates a positioning automation. In any case, a correct guide and correct mutual positioning of the superimposed cones is obtained, thus reducing the overall dimensions of the stack of cones and avoiding the use of further elements like shaped centering discs, which represent a big problem from the point of view of the automation of the process of loading of the reels to be fed to the dyeing operation. In place of centering discs, the recess 14 and the ring-like bottom 11 are provided.

In order to facilitate the flow of dyeing liquid to the zone of the cones in the vicinity of the major base, that is, where two conical surfaces are superimposed with consequent poorer flow of liquid, the slots 15, when present, faciliate the passage of some liquid.

Moreover, by using the above described cones, there is no need to position the cones to be superimposed in mutual relationship to each other, since no specific angular positioning is required, nor any modification to the traditional machines is necessary.

I claim:

1. A carrier for supporting reeled yarns on the stem of a dyeing machine comprising:

a tubular body including a body wall defining a truncated-cone external surface with axially spaced smallest and largest diameter ends and an internal, axially extending, through-socket for centering on the stem;

the through-socket having opposite axial ends adjacent the smallest and largest diameter ends, respectively;

a series of longitudinally extending dyestuff admitting slots in the body wall extending radially outwardly from the socket;

the slots progressively increasing in width as they extend radially outwardly from the socket;

a conical skirt defined by a longitudinally extension of the body wall at the largest diameter end;

the conical skirt protruding axially beyond an axial end of the socket to form a longitudinally extending recess in the largest diameter end;

an annular bottom for the recess extending around the axial end of the socket and having the same diameter as the smallest diameter end;

an annular projection protruding into the recess from the annular bottom at a location radially inwardly of and spaced apart from the skirt;

an inner surface of the projection defining an inwardly inclined profile to provide a funnel-entry surface for guiding the bottom accurately into engagement with a smallest diameter end of another, similar, carrier centered on the same stem enabling stacking of similar carriers on the same stem intermated in precise coaxial alignment.

2. A carrier according to claim 1 wherein through-holes are formed in the body at locations between the projection and the skirt which through-holes communicate with the recess and the respective slots.

3. A carrier according to claim 1 wherein openings are formed through the skirt in communication with the recess.

4. A carrier for supporting reeled yarns on the stem of a dyeing machine comprising:

a one-piece tubular body perforate to dyestuff including a body wall defining a truncated-cone external surface with axially spaced smallest and largest diameter ends and an internal axially extending, through-socket for centering on the stem;

the through-socket having opposite axial ends adjacent the smallest and largest diameter ends, respectively;

a longitudinally extension of the body wall at the largest diameter end defining a conical skirt of constant thickness protruding axially beyond an axial end of the socket to form a longitudinal recess in the largest diameter end;

an annular bottom for the recess extending around the axial end of the socket and having the same diameter as the smallest diameter end;

an annular projection protruding into the recess from the annular bottom at a location radially inwardly of and spaced apart from the skirt;

an inner surface of the projection having an inwardly inclined profile to provide a funnel-entry surface for guiding the bottom accurately into engagement with a smallest diameter end of another, similar, carrier centered on the same stem enabling stacking of similar carriers on the same stem intermated in precise co-axial alignment with the surface of the body wall at the smallest diameter end extending parallel to and spaced apart radially inwardly of the skirt to provide a yarn receiving space therebetween.

* * * * *